US010279584B2

(12) United States Patent
Cote et al.

(10) Patent No.: US 10,279,584 B2
(45) Date of Patent: May 7, 2019

(54) OBSERVATION-ENHANCED VIRTUAL MASTER SYSTEM FOR A PRINTING PRESS

(75) Inventors: Kevin Lauren Cote, Allen, TX (US); Lothar John Schroeder, West Chester, OH (US)

(73) Assignee: GOSS INTERNATIONAL AMERICAS, INC., Durham, NH (US)

( * ) Notice: Subject to any disclaimer, the term of this patent is extended or adjusted under 35 U.S.C. 154(b) by 993 days.

(21) Appl. No.: 13/186,929

(22) Filed: Jul. 20, 2011

(65) Prior Publication Data

US 2012/0055358 A1 Mar. 8, 2012

Related U.S. Application Data

(60) Provisional application No. 61/368,144, filed on Jul. 27, 2010.

(51) Int. Cl.

| | |
|---|---|
| ***B26D 1/24*** | (2006.01) |
| ***B26D 1/62*** | (2006.01) |
| ***B26D 5/24*** | (2006.01) |
| ***B26D 5/32*** | (2006.01) |
| ***B26D 9/00*** | (2006.01) |
| ***B41F 13/02*** | (2006.01) |
| ***B41F 13/58*** | (2006.01) |
| ***B41F 13/60*** | (2006.01) |

(Continued)

(52) U.S. Cl.

CPC ..... *B41F 33/02* (2013.01); *B26D 5/32* (2013.01); *B26D 9/00* (2013.01); *B41F 13/025* (2013.01); *B41F 13/58* (2013.01); *B41F 13/60* (2013.01); *B41F 23/0479* (2013.01); *B41F 33/0009* (2013.01); *B26D 1/245* (2013.01); *B26D 1/626* (2013.01); *B26D 5/24* (2013.01); *B41P 2213/734* (2013.01)

(58) Field of Classification Search

CPC .... B41F 33/0009; B41F 33/02; B41F 13/025; B41F 23/0479; B41F 13/60; B41F 13/58; B41P 2213/734; B26D 1/365; B26D 5/32; B26D 9/00; B26D 1/245; B26D 5/24; B26D 1/626

USPC ..... 101/485, 224, 226

See application file for complete search history.

(56) References Cited

U.S. PATENT DOCUMENTS 5,894,802 A * 4/1999 Jackson ..... B41F 13/12 101/248
6,526,889 B2 * 3/2003 Tokiwa ..... 101/485

(Continued)

FOREIGN PATENT DOCUMENTS

GB 2093810 A 9/1982

*Primary Examiner* — Justin Seo
*Assistant Examiner* — John M Royston
(74) *Attorney, Agent, or Firm* — Davidson, Davidson & Kappel, LLC; Jennifer L. O'Connell

(57) ABSTRACT

A web printing press is provided. The web printing press includes at least one printing unit printing images on a web, at least one press component in direct contact with the web, a cutting device for cutting the web into sheets and a controller transmitting a virtual master signal to the at least one printing unit and at least one press component. A sensor senses the at least one press component or directly senses the web downstream of the at least one print unit and generates a sensor signal. A processor receives the sensor signal and the virtual master signal, the processor transmits a modified virtual master signal to the cutting device as a function of the received sensor signal. Methods are also provided.

18 Claims, 2 Drawing Sheets

(51) Int. Cl.

| | |
|---|---|
| ***B41F 23/04*** | (2006.01) |
| ***B41F 33/00*** | (2006.01) |
| ***B41F 33/02*** | (2006.01) |

(56) References Cited

U.S. PATENT DOCUMENTS

| | | | | |
|---|---|---|---|---|
| 6,837,159 | B2 * | 1/2005 | Elkotbi et al. | 101/219 |
| 2005/0061189 | A1 * | 3/2005 | Brandenburg | B41F 13/025 101/485 |
| 2005/0193907 | A1 * | 9/2005 | Richards | B65H 23/1882 101/226 |
| 2005/0247220 | A1 * | 11/2005 | Brandenburg | B26D 5/20 101/226 |
| 2005/0284316 | A1 * | 12/2005 | Rugamer | B41F 13/0045 101/216 |
| 2006/0005722 | A1 * | 1/2006 | Nobukawa et al. | 101/181 |
| 2006/0267529 | A1 * | 11/2006 | Piefer | B41F 13/004 318/432 |
| 2008/0105153 | A1 * | 5/2008 | Hahn | B41F 13/12 101/485 |
| 2008/0148980 | A1 * | 6/2008 | Ollivier | B41F 13/0045 101/484 |

* cited by examiner

OBSERVATION-ENHANCED VIRTUAL MASTER SYSTEM FOR A PRINTING PRESS

This claims the benefit of U.S. Provisional Application No. 61/368,144 filed Jul. 27, 2010, and hereby incorporated by reference herein.

The present invention relates to printing presses, and more particularly to printing presses which utilize a virtual master to provide proper commands to various press components.

BACKGROUND

U.S. Pat. No. 5,894,802 describes a method and apparatus for establishing an isolated position reference in a printing operation. To compensate for discrepancies that can arise over time between isolated position reference signals generated by different regulators, and to avoid problems in the printing process that would result from such discrepancies, the isolated position reference signals generated within the various regulators can be periodically corrected or standardized. In accordance with one of the exemplary embodiments, the isolated position reference signals are corrected or standardized at a time when the print unit chosen as the standard is not being influenced by transient disturbances. This configuration can, for example, be applied to an existing printing press that, due to original design limitations, cannot transmit the same isolated position reference signal to all of its drive units.

SUMMARY OF THE INVENTION

One deficiency of this concept is that the system does not know or react to variations in roll motions. Any disturbances, such as a mechanical transmission error, will cause variations in the roll motions. These variations in roll motion cause the web to strain which shifts the print alignment relative to the cut.

The present invention provides a web printing press that includes at least one printing unit printing images on a web, at least one press component in direct contact with the web and a cutting device for cutting the web into sheets. A controller transmits a virtual master signal to the at least one printing unit and at least one press component. A sensor senses the at least one press component or directly senses the web downstream of the at least one print unit and generates a sensor signal. A processor receives the sensor signal and the virtual master signal. The processor transmits a modified virtual master signal to the cutting device as a function of the received sensor signal.

The present invention also provides a method for printing a web. The method includes the steps of printing a web using a printing unit receiving a virtual master signal, sensing a characteristic of a press component in direct contact with the web or directly sensing a characteristic of the web downstream of the printing unit and modifying the virtual master signal for a further press component downstream of the print unit and the press component as a function of the sensed characteristic.

The present invention further provides a method for printing a web. The method includes the steps of printing a web using a printing unit receiving a virtual master signal, acting on the printed web with at least one press component receiving the virtual master signal, determining a deviation between the virtual master signal and an actual characteristic of the at least one press component and modifying the virtual master signal for a further press component downstream of the at least one press component as a function of the deviation.

Preferred embodiments of the present invention may include one or more of the following features. The virtual master signal may include velocity, position and acceleration information. The modified virtual master signal may correct the print to cut alignment of the image printed on the web. The sensor may sense an actual velocity of the at least one press component or an actual velocity of the web downstream of the at least one press component. The processor may compare the actual velocity of the at least one press component or the actual velocity of the web downstream of the at least one press component with the virtual master signal and may provide the modified virtual master signal to compensate for any undesired variations. The web printing may include at least one web compensator for guiding the web to the cutting device, the web compensator may also receive the modified virtual master signal to correct any change in the print to cut alignment. The at least one press component may be driven by a dedicated motor and the cutting device may be driven by a dedicated motor. The at least one press component may be, for example, a chill unit or a slitter. The sensor may be an encoder on the at least one press component.

Preferred embodiments of the present invention may also include one or more of the following features. Modifying the virtual master signal may include generating a modified virtual master signal and sending the modified virtual master signal to the further press component. Sensing a characteristic may include using an encoder on the press component. The further press component may be a cutting device cutting the web or a web compensator guiding the web. Determining a deviation may include sensing an actual velocity of the at least one press component. The method of printing may include the step of observing a characteristic of the printed web downstream of the at least one press component.

DETAILED DESCRIPTION

Printing presses may include a plurality of individually driven press components each having a dedicated motor. These individually driven press components may be, for example, print units, blanket cylinders, plate cylinders, chill units, slitters, cut cylinders and web or ribbon compensators. A printing press may employ a virtual master system to control the individually driven components. The virtual master system sends an identical, virtual master signal to each dedicated drive of the individually driven press components in order to maintain a uniform drive throughout the printing press during the printing process. The virtual master signal typically includes a velocity component and a position setpoint component.

The virtual master signal does not compensate for real-time press activity. As a result, no drive has information about how the other drives are operating. So, the virtual master signal is not able to compensate for or react to variations, for example, roll motions, that may occur in the printing press components. Any disturbances, such as a mechanical transmission error, may cause variations in the roll motion of press components and affect the velocity of the press components, the velocity of the web and/or print-to-cut alignment.

The variations in roll motion may cause strain in the web which shifts the print-to-cut alignment. Thus, the printed image is shifted with respect to the cut which may lead to waste or undesirable products. In accordance with the present invention, a modified virtual master signal is employed that compensates for variations in the web or press components and any resulting changes in print to cut register and alignment. A virtual master signal is sent to the cut cylinder and may be modified as desired to compensate for undesired roll motions or press/web variations. Thus, understanding system, web and register dynamics allows predictions of print relative to cut for various roll motions and other disturbances.

Figure 1:
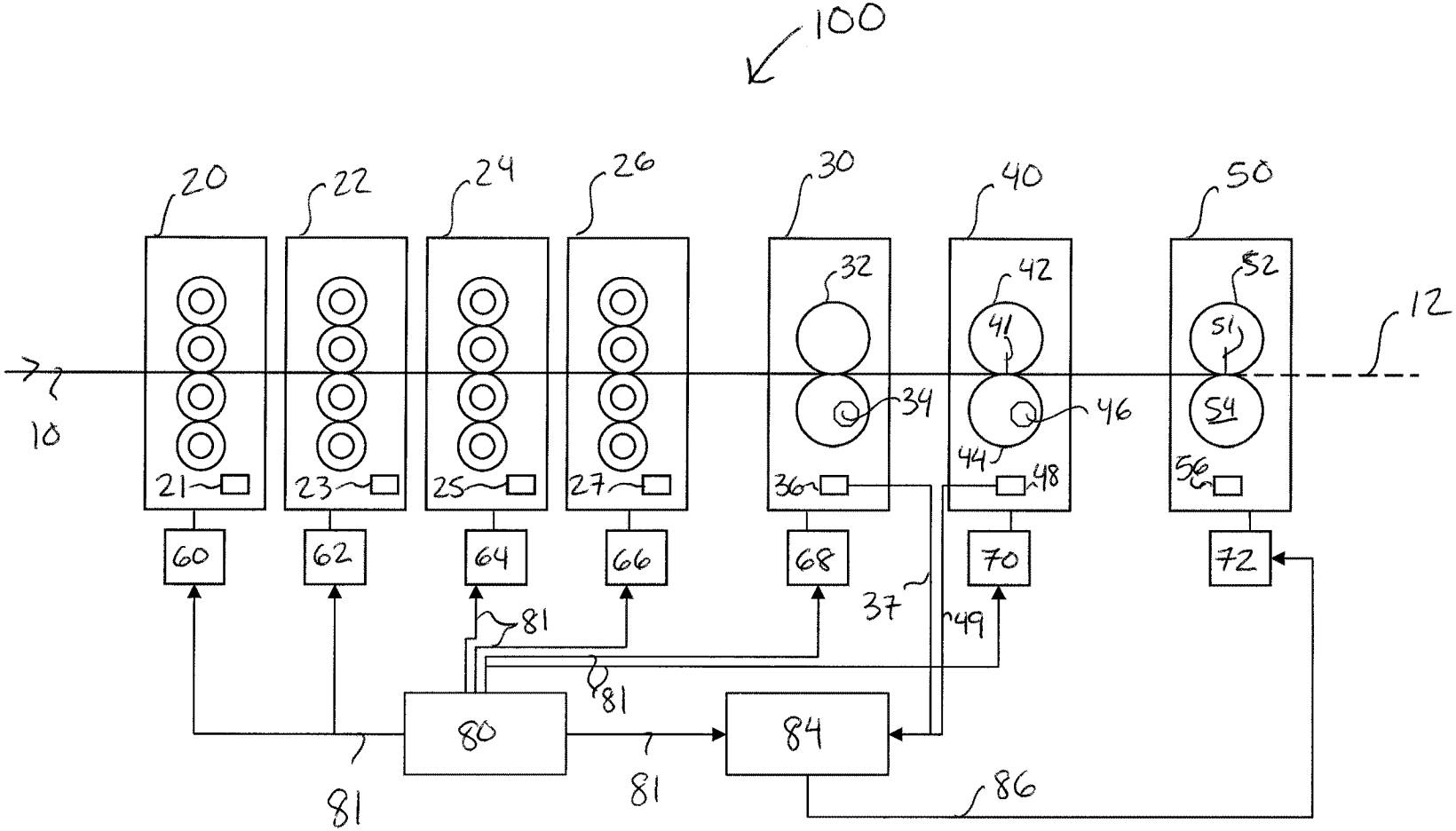
FIG. 1 shows schematically a first exemplary embodiment of a printing press and virtual master control system of the present invention.

FIG. 1 shows an embodiment of a virtual master control system in accordance with the present invention. A printing press 100 includes a plurality of individually driven press components. Printing units 20, 22, 24, 26 each print an image on a web 10. Each print unit 20, 22, 24, 26 may print a different color, for example, cyan, magenta, yellow and black. Each print unit may 20, 22, 24, 26 be a perfecting offset print unit and include two blanket cylinders and two plate cylinders. Each print unit may include a motor or drive, 21, 23, 25, 27, respectively. Alternatively, only one print unit may be driven and the remaining print units may be geared to the driven print unit. Each print unit drive 21, 23, 25, 27 is connected to a print unit controller 60, 62, 64, 66. The printing press may preferably be a multicolor offset lithographic printing press; with for example four print units which receive the same virtual master signal.

Other individually driven press components include a chiller 30 for chilling web 10 after web 10 has been printed on by print units 20, 22, 24, 26 and a slitter 40 for slitting web 10 into a plurality of ribbons. A cutting unit 50 may be provided to cuts web 10 or ribbons into sheets 12. Chill unit 30 may include two chill rolls 32 and an encoder 34. Chill rolls 32 may be in direct contact with web 10. Chill rolls 32 are driven by a motor 36 which is connected to a controller 68. Encoder 34 measures the actual velocity of chill roll 32.

Slitter 40 may slit web 10 into a plurality of ribbons. Slitter 40 includes a slitting cylinder pair 42, 44 having at least one knife 41 or blade for slitting web 10 in the direction of web travel. Slitting cylinder pair 42, 44 includes an encoder 46 for measuring the actual velocity of slitting cylinder pair 42, 44. Slitter 40 also includes a motor 48 that drives cylinder pair 42, 44. Motor 48 is connected to a controller 70. Slitting cylinder pair 42, 44 may be in direct contact with web 10 as slitter blade 46 slits web 10.

Cutting unit 50 includes a cutting cylinder pair 52, 54 having at least one knife 51 or blade for cutting the web 10 across the direction of travel into sheets 12. Cutting unit 50 is individually driven by a respective motor 56 which is connected to a controller 72.

Each motor 21, 23, 25, 27, 36, 48 is connected to a respective controller 60, 62, 64, 66, 68, 70 in printing press 100. Alternatively, each motor may be connected to one controller or any desired number of controllers. Each controller 60, 62, 64, 66, 68, 70 is connected to a virtual master processing device 80. Virtual master processing device 80 sends a signal 81 to each controller 60, 62, 64, 66, 68, 70 thereby instructing each controller 60, 62, 64, 66, 68, 70 to operate corresponding motor 21, 23, 25, 27, 36, 48. Signal 81 includes position, velocity and acceleration commands for motors 21, 23, 25, 27, 36, 48.

Since chill rolls 32 and slitting pair 42, 44 contact web 10 directly during printing operation, any deviations in the actual velocity relative to the desired velocity of chill rolls 32 and slitting pair 42, 44 will cause web 10 to strain and affect the print-to-cut register of cutting cylinder pair 52, 54. Thus, in accordance with the present invention, encoders 34, 46 are used to determine the actual velocity of chill rolls 32 and slitting pair 42, 44. Actual velocity 37 of chill rolls 32 and actual velocity 49 of slitting cylinder pair 52, 54 are sent to web and register processor 84. Web and register processor 84 compares the virtual master signal 81 with actual velocities 37, 49 and estimates how much a printed image has shifted on the web 10 relative to the anticipated cut. Web and register processor 84 then transmits a modified virtual master signal 86 to controller 72 of cutting device 50 to compensate for any roll motion deviations or variation in chill unit 30 or slitter 40. Thus, modified virtual master signal 86 controls motor 56. Modified virtual master signal 86 transmitted to cutting device 50 may be different then virtual master signal 81 transmitted by processor 80 since modified signal 86 compensates for variations and changes in web characteristics or press components, specifically variations and changes that may affect print-to-cut register.

For example, if a mechanical disturbance causes chill roll motor 36 to move relative to the chill roll 32 itself, actual velocity 37 measured at the chill roll 32 or web 10 at the chill unit 30, will differ from virtual master velocity included in virtual master signal 81. Web and register processor 84 measures this difference, and transmits a modified virtual master signal 86 to cutting device 50 to correct for the variation. Thus, controller 72 controls the speed of motor 56 based on the information provided in modified virtual master signal 86.

Being able to observe a characteristic of web 10 and/or press components 30, 40 provides real time information for printing press 100. With this information, processor 84 can calculate or determine the deviation between virtual master signal 81 and the observed qualities of web 10 or press components 30, 40, for example, actual velocities 37, 49. By updating the virtual master signal 81 with a modified virtual master signal 86 errors in downstream processing, for example, cutting the web into sheets, may be reduced. The observed characteristics of the web and/or press components may be directly sensed from the web or press components themselves or determined empirically or any combination thereof.

In another preferred alternative, sensors on web may be used to determine the web velocity or strain on the web. Sensors may be located downstream of each individually driven component to detect the fluctuations in web characteristics.

In a further preferred embodiment, virtual master processor 80 may send virtual master signal 81 to controller 72 of cutting device 50. Web and register processor 84 may then send a modified virtual master signal 86 to controller 72. Based on the differences between signals 81, 86, controller 72 will advance or retard motor 56 as needed. Alternatively, if virtual master signal 81 is sent to controller 72, modified virtual master signal 86 many only include information for modifying the original virtual master signal 81 as desired instead of tranmitting a new, complete modified virtual master signal 86.

A modified virtual master signal may also be employed in duplex web presses. In this case the web compensators for each press are modified along with the cutting device.

Observed characteristics, for example, roll motion information, from each press are used to estimate the shift of the print relative to the cut. Since the effect of these observed characteristics can be estimated, modified signals can be sent to the web compensators and cutting device which minimizes the shift of the print relative to the cut caused by variations or disturbances during printing, for example, roll motion in press components.

Figure 2:
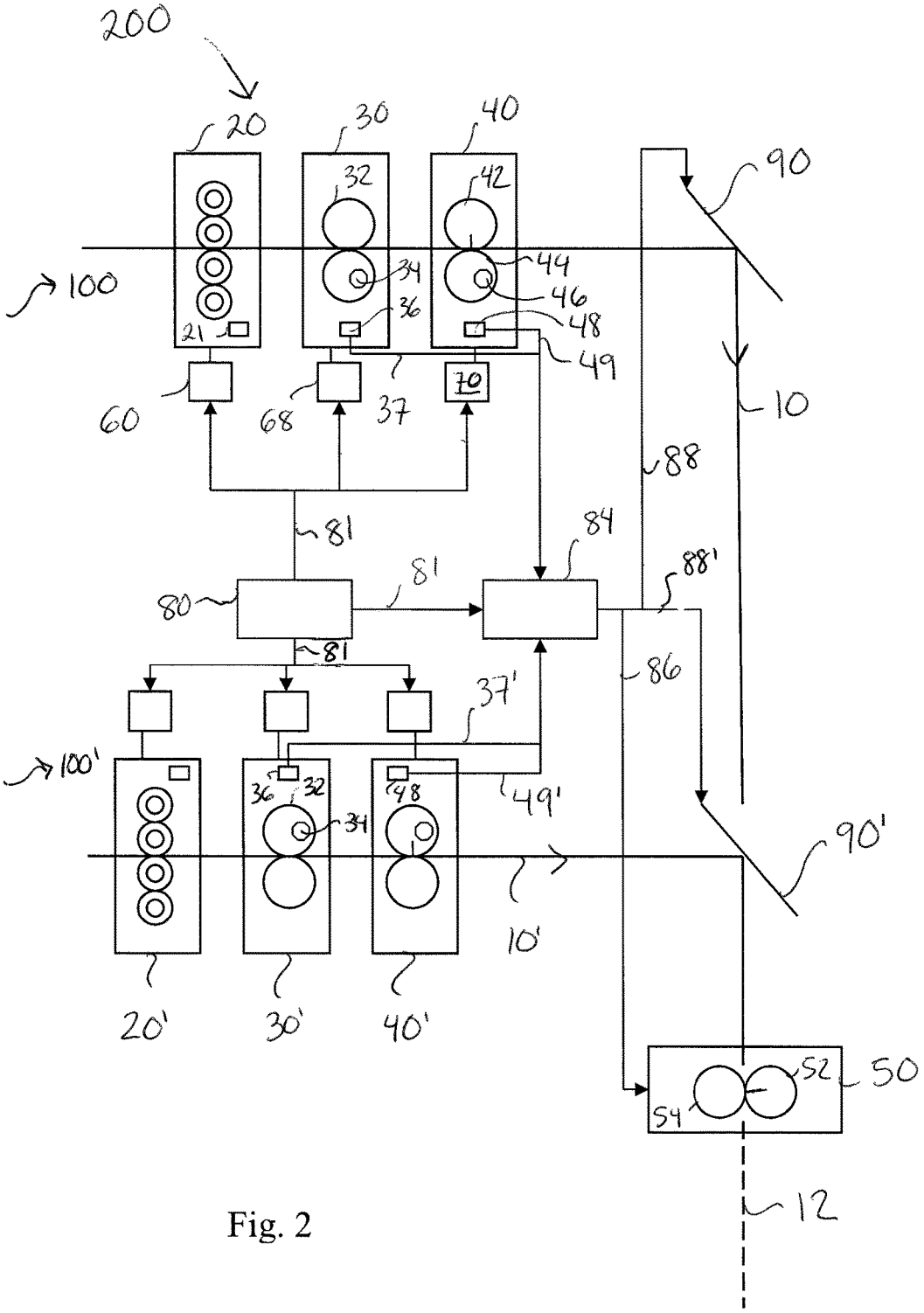
FIG. 2 shows schematically a second exemplary embodiment of a printing press and virtual master control system of the present invention.

FIG. 2 shows an embodiment of the virtual master control system for a duplex press 200 in accordance with another preferred embodiment of the present invention. Duplex press 200 includes two presses, 100, 100' which include components similar to those in printing press 100 shown in FIG. 1. The same components are identified by the same reference numerals and will not be described in detail again. Printing press 200 includes printing units 20, 20' driven by motors 21, 21' which are connected to controllers 60, 60', respectively. More than one printing unit may be provided for each web 10, 10'. Chill units 30, 30' are individually driven by motors 36, 36' which are connected to controllers 68, 68'. Encoders 34, 34' on one of chill rolls 32, 32' records the actual velocity 37, 37' of chill rolls 32, 32'. Slitters 40, 40' are individually driven by motors 48, 48' which are connected to controllers 70, 70'. Slitting pairs 42, 44, 42', 44' include encoders 48, 48' for measuring the actual velocity 49, 49' of slitting pairs 42, 44, 42', 44'. Web compensators 90, 90' are provided for guiding webs 10, 10' to cutting device 50. Chill units 30, 30', slitters 40, 40' and web compensators 90, 90' directly contact webs 10, 10', thus any variation in roll motion of these components may change the velocity of webs 10, 10' and affect print to cut register.

Each controller 60, 68, 70, 60', 68', 70' is connected to a virtual master processing device 80. Virtual master processing device 80 sends a signal 81 to each controller 60, 68, 70, 60', 68', 70' to operate corresponding motor 21, 36, 48, 21', 36', 48'. Signal 81 includes position, velocity and acceleration commands for each press 100, 100'.

Web and register processor 84 estimates the amount the print shift relative to the cut for each web 10, 10' based on roll motion variations. Virtual master processing device 80 sends a virtual master signal 81 to a web and register processor 84. Actual roll velocities 37, 49, 37', 49' are also inputs to web and register processor 84. Web and register processor 84 calculates the estimated amount the print shifted relative to the cut and uses this estimate to transmit modified virtual master signals 88, 88', 86. Web compensators 90, 90' receive modified virtual master signals 88, 88', respectively. Processor 84 transmits modified virtual master signal 86 to cutting device 50. Alternately, ribbon compensators can be used instead of or in conjunction with the web compensators 90, 90'. In an alternative preferred embodiment, web compensators 90, 90' and/or cutting device 50 may each be connected to controllers that receive the modified virtual master signals 88, 88', 50, respectively.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A web printing press comprising:

at least one printing unit printing images on a web;

at least one press component in direct contact with the web;

a cutting device for cutting the web into sheets;

a controller transmitting a virtual master signal to the at least one printing unit and at least one press component;

a sensor sensing the at least one press component or directly sensing the web downstream of the at least one print unit and generating a sensor signal; and a processor receiving the sensor signal and the virtual master signal, the processor transmitting a modified virtual master signal to the cutting device as a function of the received sensor signal;

the cutting device cutting the web into sheets as a function of the modified virtual master signal;

wherein the at least one printing unit, the at least one press component, and the cutting device are each driven by a different motor.

2. The web printing press as recited in claim 1 wherein the virtual master signal includes velocity, position and acceleration information.

3. The web printing press as recited in claim 1 wherein the modified virtual master signal corrects the print to cut alignment of the image printed on the web.

4. The web printing press as recited in claim 1 wherein the sensor senses an actual velocity of the at least one press component or an actual velocity of the web downstream of the at least one press component.

5. The web printing press as recited in claim 4 wherein the processor compares the actual velocity of the at least one press component or the actual velocity of the web downstream of the at least one press component with the virtual master signal and provides the modified virtual master signal to compensate for any undesired variations.

6. The web printing press as recited in claim 1 further comprising at least one web compensator for guiding the web to the cutting device, the web compensator also receiving the modified virtual master signal to correct any change in the print to cut alignment.

7. The web printing press as recited in claim 2, wherein the modified virtual master signal includes velocity, position, and acceleration information.

8. The web printing press as recited in claim 1, wherein the virtual master signal and the modified virtual master signal each include velocity, position, and acceleration commands.

9. The web printing press as recited in claim 1 wherein the at least one press component is a chill unit or a slitter.

10. The web printing press as recited in claim 1 wherein the sensor is an encoder on the at least one press component.

11. A method for printing a web comprising the steps of:

printing a web using a printing unit receiving a virtual master signal, the virtual master signal including a first position component, a first velocity component and a first acceleration component;

sensing a characteristic of a press component in direct contact with the web or directly sensing a characteristic of the web downstream of the printing unit;

generating a modified virtual master signal as a function of the sensed characteristic and the virtual master signal, the modified virtual master signal including a second position component, a second velocity component and a second acceleration component, wherein at least one of the second position component, second velocity component and second acceleration component differs from the first position component, first velocity component and first acceleration component, respectively;

transmitting the modified virtual master signal to a cutting device cutting the web or a web compensator guiding the web downstream of the print unit and the press component; and cutting the web into sheets or guiding the web as a function of the modified virtual master signal.

12. The method as recited in claim 11 wherein the step of sensing a characteristic includes using an encoder on the press component.

13. The method as recited in claim 11 wherein the first and second velocity components, the first and second acceleration components, and the first and second position components are comprised of respective first and second velocity commands, first and second acceleration commands, and first and second position commands.

14. A method for printing a web comprising the steps of:

printing a web using a printing unit receiving a virtual master signal;

acting on the printed web with a first press component receiving the virtual master signal, the first press component downstream of the printing unit;

sensing a characteristic of the first press component;

determining a first deviation between the virtual master signal and the characteristic of the first press component;

generating a modified virtual master signal as a function of the first deviation and the virtual master signal, the modified virtual master signal including a position component, a velocity component and an acceleration component, transmitting the modified virtual master signal to a cutting device cutting the web into sheets or a web compensator guiding the web downstream of the first press component; and cutting the web into sheets or guiding the web as a function of the modified virtual master signal.

15. The method as recited in claim 14 wherein the step of modifying the virtual master signal includes generating a modified virtual master signal and sending the modified virtual master signal to the cutting device or web compensator.

16. The method as recited in claim 14 wherein the step of sensing includes sensing a velocity of the first press component.

17. The method as recited in claim 14 wherein the virtual master signal and the modified virtual master signal each includes a position command, a velocity command and an acceleration command.

18. The method recited in claim 14 further comprising the steps of:

acting on the printed web with a second press component receiving the virtual master signal, the second press component downstream of the first press component and upstream of a further press component;

sensing a characteristic of the second press component; and determining a second deviation between the virtual master signal and the characteristic of the second press component; and wherein the step of generating comprises generating a modified virtual master signal for the second press component as a function of the first and second deviations.

* * * * *